US009434083B2

(12) United States Patent
Douillard et al.

(10) Patent No.: US 9,434,083 B2
(45) Date of Patent: Sep. 6, 2016

(54) DOUBLE CUT FOLDER WITH VARIABLE KNIFE MOUNTING LOCATIONS ON CUTTING CYLINDERS

(71) Applicant: Goss International Americas Inc., Durham, NH (US)

(72) Inventors: Gerald Roger Douillard, Manchester, NH (US); John James Sposato, Jr., Dover, NH (US); David Clarke Pollock, Somersworth, NH (US); Dieter Theodor Ebert, Stratham, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 13/868,207

(22) Filed: Apr. 23, 2013

(65) Prior Publication Data

US 2013/0294808 A1 Nov. 7, 2013

Related U.S. Application Data

(60) Provisional application No. 61/641,036, filed on May 1, 2012.

(51) Int. Cl.

| | |
|---|---|
| ***B26D 1/40*** | (2006.01) |
| ***B26D 7/26*** | (2006.01) |
| ***B26D 9/00*** | (2006.01) |
| ***B26F 1/08*** | (2006.01) |
| ***B41F 13/60*** | (2006.01) |
| ***B26F 1/20*** | (2006.01) |

(52) U.S. Cl.

CPC ..... *B26D 1/405* (2013.01); *B26D 7/26* (2013.01); *B26D 7/2614* (2013.01); *B26D 9/00* (2013.01); *B26F 1/20* (2013.01); *B41F 13/60* (2013.01); *B26F 1/08* (2013.01); *Y10T 29/49716* (2015.01); *Y10T 83/4838* (2015.04)

(58) Field of Classification Search

CPC ..... B26D 1/405; B26D 7/2614; B41F 13/60; B41F 13/58

USPC ..... 83/698.51, 346, 347; 270/5.02, 5.03, 270/21.1

See application file for complete search history.

(56) References Cited

U.S. PATENT DOCUMENTS

| | | | | |
|---|---|---|---|---|
| 4,009,626 | A * | 3/1977 | Gressman | 83/116 |
| 4,811,641 | A * | 3/1989 | Muller | 83/105 |
| 5,740,709 | A * | 4/1998 | Boston et al. | 83/308 |
| 5,865,082 | A | 2/1999 | Cote et al. | 83/155 |
| 5,957,050 | A * | 9/1999 | Scheffer et al. | 101/227 |
| 6,009,781 | A * | 1/2000 | McNeil | 83/37 |
| 6,684,746 | B2 | 2/2004 | Hilliard et al. | 83/325 |
| 8,104,755 | B2 | 1/2012 | Dawley et al. | 270/52.17 |
| 2010/0101386 | A1 | 4/2010 | Jackson et al. | |

* cited by examiner

*Primary Examiner* — Daniel J Colilla

(74) *Attorney, Agent, or Firm* — Davidson, Davidson & Kappel, LLC

(57) ABSTRACT

A double cut folder is provided for a printing press. The folder has a first cutting cylinder pair including a first knife cylinder and a first anvil cylinder for perforating a web, and a second cutting cylinder pair including a second knife cylinder and a second anvil cylinder for cutting the web into signatures. Each cutting cylinder pair includes a plurality of knife mounting locations and a plurality of cutting rubber locations. Each knife mounting location is configured to hold a knife box. A first subset of the plurality of knife mounting locations each have a knife box secured therein, and a second subset of the plurality of knife mounting locations do not have a knife box secured therein.

7 Claims, 4 Drawing Sheets

DOUBLE CUT FOLDER WITH VARIABLE KNIFE MOUNTING LOCATIONS ON CUTTING CYLINDERS

This application claims priority to U.S. Provisional Application Ser. No. 61/641,036, filed May 1, 2012, the entire disclosure of which is hereby incorporated by reference.

CROSS-REFERENCE TO RELATED APPLICATIONS

This application contains subject matter related to commonly owned U.S. application Ser. No. 13/862,807, filed Apr. 15, 2013, the entire disclosure of which is hereby incorporated by reference.

FIELD OF THE INVENTION

The present invention relates generally to printing press equipment and more particularly to cutting devices and cutting folders.

BACKGROUND

U.S. Pat. No. 5,865,082, hereby incorporated by reference herein, discloses a first conveyor assembly and a second conveyor assembly. Cooperating cutting cylinders having a knife and an anvil are integrated into paths of the conveying elements of the first and second conveyor assemblies, seizing a web of material prior to a cutting operation.

U.S. Pat. No. 6,684,746, hereby incorporated by reference herein, discloses cutting a web by linearly moving a plurality of cutting elements in a same direction as web in a signature formation area and cutting the web with the cutting elements to form signatures. A length of the signatures is varied by varying the spacing between the cutting elements in the signature formation area.

U.S. Pat. No. 8,104,755, hereby incorporated by reference herein, discloses an adjustable delivery web conversion apparatus. A variable cutoff printing unit prints pages on a web is slit into ribbons. A cutting apparatus cuts the ribbons into signatures. A controller controls the cutting apparatus based on the printing by the variable cutoff printing unit so the pages are properly positioned on the signatures.

SUMMARY OF THE INVENTION

Typically, individual products have dedicated folder deliveries which accommodate the characteristics of the associated products. Other deliveries accommodate variable cut lengths of products by increasing the speed of the cutting cylinders relative to the web in order to shorten the length of the product or decreasing the speed of the cutting cylinders relative to the web in order to increase the length of the product. However, the speed of the knife blades on the cutting cylinder may cause performance issues and product damage.

The ability to produce products of different cut lengths is a desirable feature for many printers. Most cutter or former folders are single cut. The formation of the signature from the ribbon package is made in a single operation. As a result, it is possible to change the length of the cut signature by increasing or decreasing the rotational speed of the cutting cylinders or by replacing a set of cutting cylinders with another that has a different circumference than the previous.

Double cutting ribbons into signatures is known in the art. Double cutting allows the folder tapes to have custody of the ribbons prior to the complete formation of the signatures. In a double cut folder arrangement, a first pair of cutting cylinders slits or perforates the web and a second cutting cylinder pair further cuts the web into signatures.

For a double cut folder to operate properly, the first cut should have zero relative speed difference compared to the paper. Thus, it is not possible to increase or decrease the rotational speed of the first cut cylinders to change the cut length. Doing so would cause product damage due to the relative speeds of the knife to the paper.

Previously, discrete cut length changes may have been done by varying the circumference of the cutting cylinders by displacing a set of cutting cylinders with a second set of cutting cylinders having a different circumference. However, the brackets required for this setup must be accurately located and the drive method may be complicated and expensive.

An electronic cam profile may be used for the cutting cylinder drive to speed or slow the cylinders relative to the paper while the knife is not in contact with the paper, but match the speed of the paper while the knife is in contact with the paper. Due to the high inertia of the cutting cylinders as well as the limitation in the sampling frequency of the drive controller, the web speed may be limited to a fraction of today's desirable folder speeds.

The present invention provides discrete cut length changes of a product by relocating knife and cutting rubber sub-assemblies to various discrete locations around a cutting cylinder. Preferably, the cutting cylinder would be nominally the size of a print unit blanket cylinder. In a preferred embodiment, the blanket circumference may be 1220 mm. Desirable product sizes may include of 203.33 mm, 244 mm and 305 mm products from a 1220 mm blanket circumference.

In addition to the cut product length, the cutting cylinders may be sized for a common short grain print unit that has, for example, a diameter of 890 mm. A cutting cylinder of this size may produce three products of 296.7 mm or four products of 222.5 mm.

In accordance with a first embodiment of the present invention, a double cut folder for a printing press comprises a first cutting cylinder pair including a first knife cylinder and a first anvil cylinder for perforating a web, and a second cutting cylinder pair including a second knife cylinder and a second anvil cylinder for cutting the web into signatures. Each cutting cylinder pair including a plurality of knife mounting locations and a plurality of cutting rubber locations. Each knife mounting location configured to hold a knife box, wherein a first subset of the plurality of knife mounting locations each have a knife box secured therein, and a second subset of the plurality of knife mounting locations do not have a knife box secured therein.

The aforementioned embodiment may also include other optional components and features. For example, the following features may be included, in any combination:

In accordance with another aspect of the first embodiment, all of the knife mounting locations of the first cutting cylinder pair are on the first knife cylinder, and all of the knife mounting locations of the second cutting cylinder pair are on the second knife cylinder. Alternatively, some of the knife mounting locations of the first (and/or second) cutting cylinder pair can be on the first knife cylinder and some of the knife mounting locations of the first (and/or second) cutting cylinder pair can be on the first anvil cylinder.

In accordance with another aspect of the first embodiment, each of the plurality of cutting rubber locations has a cutting rubber secured therein.

In accordance with another aspect of the first embodiment, on each of the first and second knife cylinders, the first subset of the plurality of knife mounting locations are equally spaced apart from each other along a circumference of the respective first and second knife cylinders, and the second subset of the plurality of knife mounting locations are not equally spaced apart from each other along the circumference of the respective first and second knife cylinders. In this regard, for example, the first subset may consist of 4 knife mounting locations, and the second subset may consist of 8 knife mounting locations; or the first subset may consist of 5 knife mounting locations, and the second subset may consist of 7 knife mounting locations; or the first subset may consist of 6 knife mounting locations, and the second subset may consist of 6 knife mounting locations.

In accordance with another aspect of the first embodiment, on each of the first and second anvil cylinders, a first subset of the plurality of cutting rubber locations each have a cutting rubber secured therein, and the first subset of the plurality of cutting rubber locations are equally spaced apart from each other along a circumference of the respective first and second anvil cylinders.

In accordance with another aspect of the first embodiment, on the first anvil cylinder, each cutting rubber location is positioned to be opposite a respective one of the knife mounting locations when in a first nip formed by the first knife cylinder and the first anvil cylinder, and on the second anvil cylinder, each cutting rubber location is positioned to be opposite a respective one of the knife mounting locations when in a second nip formed by the second knife cylinder and the second anvil cylinder.

In accordance with another aspect of the first embodiment, at least one tape passes between the second knife cylinder and the second anvil cylinder.

In accordance with another aspect of the first embodiment, a printing press is provided which includes a folder according to the first embodiment as described above, and a printing unit including a plate cylinder and a blanket cylinder. The printing unit is upstream of the folder, and the first and second knife cylinders having a same circumference as the blanket cylinder.

In accordance with a second embodiment of the present invention, a method of cutting a web into variable length signatures is provided. The method includes perforating a web with a first cutting cylinder pair and cutting the web into signatures having a first length with a second cutting cylinder pair. In this regard, each cutting cylinder pair includes a plurality of knife mounting locations and a plurality of cutting rubber locations; each knife mounting location is configured to hold a knife box; a first subset of the plurality of knife mounting locations each have a knife box secured therein, and a second subset of the plurality of knife mounting locations do not have a knife box secured therein. The method further includes, on the first cutting cylinder pair and on second cutting cylinder pair, removing one or more of the knife boxes from the first subset of knife mounting locations and securing one or more knife boxes into respective ones of the second subset of knife mounting locations, and thereafter, perforating a web with the first cutting cylinder pair and cutting the web into signatures having a second length with the second cutting cylinder pair.

The aforementioned embodiment may also include other optional components and features. For example, the following features may be included, in any combination:

In accordance with another aspect of the second embodiment, the plurality of knife mounting locations include twelve locations, and, during said cutting the web into signatures of the first length, four of the twelve knife mounting locations hold respective knife boxes. Further, the step of removing includes removing three of the four knife boxes, and the step of securing includes securing four or five knife boxes into respective ones of the second subset of knife mounting locations.

In accordance with another aspect of the second embodiment, the plurality of knife mounting locations include twelve locations, and, during said cutting the web into signatures of the first length, five of the twelve knife mounting locations hold respective knife boxes. Further, the step of removing includes removing four of the five knife boxes, and the step of securing includes securing three or five knife boxes into respective ones of the second subset of knife mounting locations.

In accordance with another aspect of the second embodiment, the plurality of knife mounting locations include twelve locations, and, during said cutting the web into signatures of the first length, six of the twelve knife mounting locations hold respective knife boxes. Further, the step of removing includes removing five of the six knife boxes, and the step of securing includes securing three or four knife boxes into respective ones of the second subset of knife mounting locations.

In accordance with another aspect of the second embodiment, the first cylinder pair includes a first knife cylinder and a first anvil cylinder, and the second cylinder pair includes a second knife cylinder and a second anvil cylinder.

In accordance with another aspect of the second embodiment, the method further comprises supporting the web and signatures using tapes, the tapes running between the second knife cylinder and the second anvil cylinder.

In accordance with another aspect of the second embodiment, all of the knife mounting locations of the first cutting cylinder pair are on the first knife cylinder, and all of the knife mounting locations of the second cutting cylinder pair are on the second knife cylinder. Alternatively, some of the knife mounting locations of the first (and/or second) cutting cylinder pair can be on the first knife cylinder and some of the knife mounting locations of the first (and/or second) cutting cylinder pair can be on the first anvil cylinder.

BRIEF DESCRIPTION OF THE DRAWINGS

The invention will be better understood from a reading of the following description, given purely by way of example, with reference to the appended drawings, in which.

DETAILED DESCRIPTION

For a single cut folder, the signature creation is often limited by snap back and pushing the lead edge of the paper into machine tapes. Snap back causes the signature to become non-planar and can produce skew in the cut edge. A common method to reduce snap back is through the use of a final nipping point as close to the entrance of the cutting cylinders as possible. A second limitation is pushing the lead edge of the paper into machine tapes, which are used to transport signatures to downstream operations. In order to maximize performance with a single cut folder, the entrance to the machine tapes is located as close to the cutting cylinders as possible. One of the ways to minimize the distance between the cutting cylinder and the tape entrance or the cutting cylinder and the final nip point is by minimizing the diameters of the cutting cylinders. It is common for a nominal cutting cylinder circumference to be 610 mm for a 1220 mm blanket cylinder circumference.

One of the purposes of the double cut folder is to allow machine tapes to guide the paper during the signature formation process. Thus, tapes are allowed to pass through the second cut cylinders. Thus, the provision of tapes may make it unnecessary to minimize the diameter of the cutting cylinders.

Figure 1:
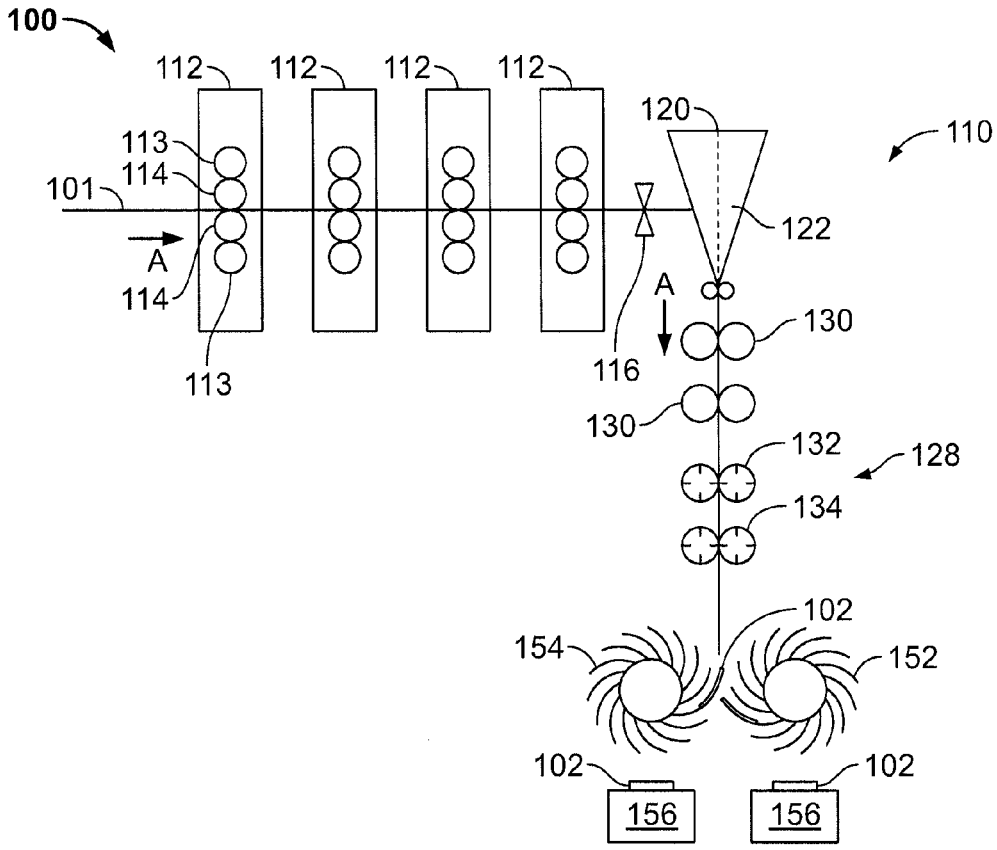
FIG. 1 shows a schematic representation of a printing press including a cutting folder according to the present invention.
Figure 2A:
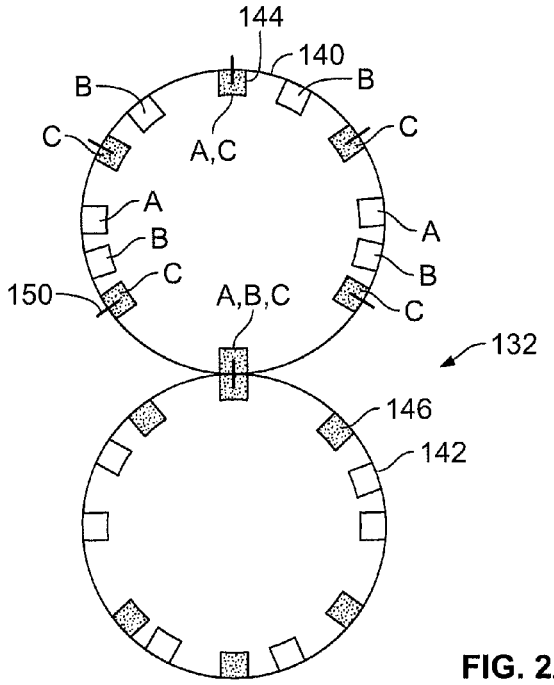
FIG. 2 (*a*) through (*d*) shows cutting cylinder pair as shown in FIG. 1.
Figure 2B:
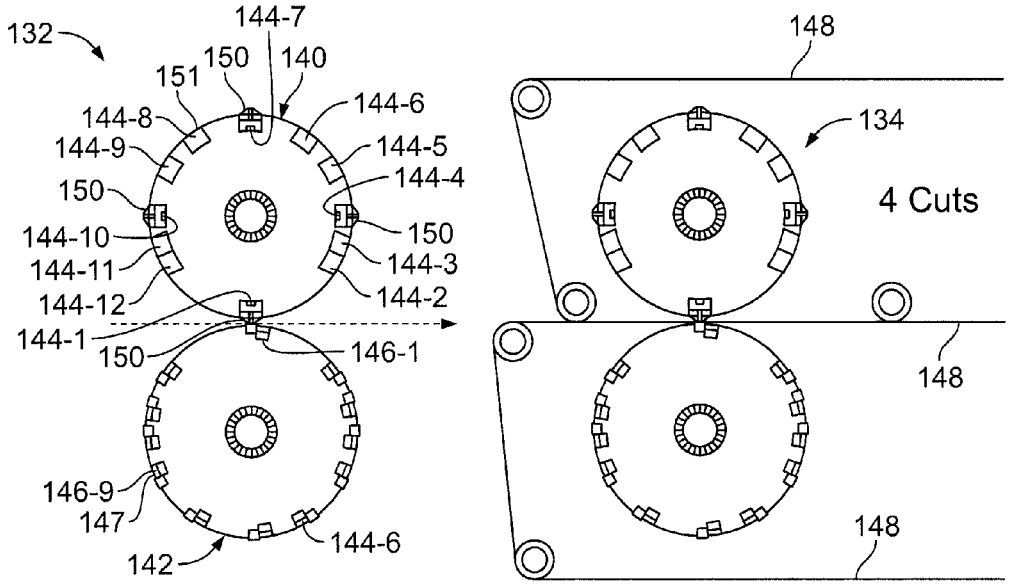
Figure 2C:
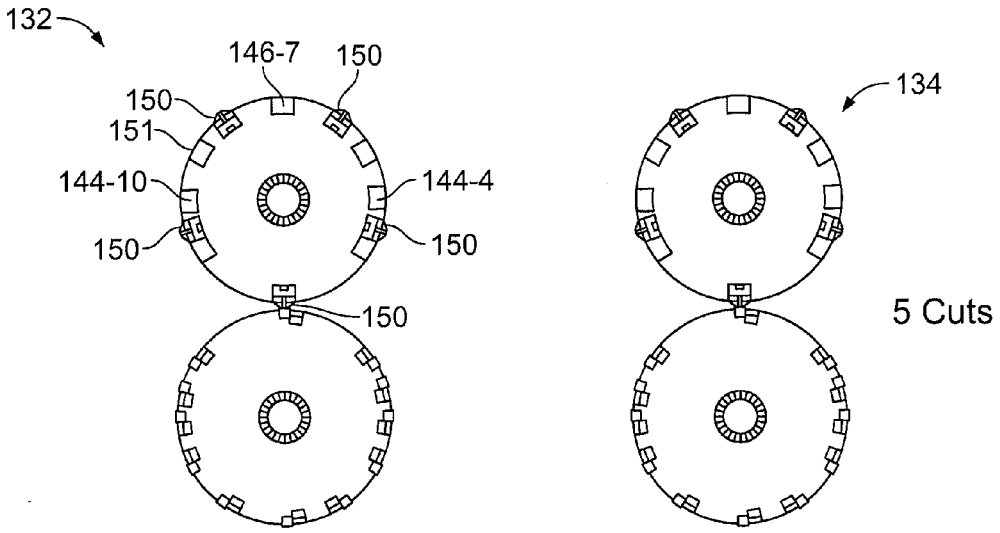
Figure 2D:
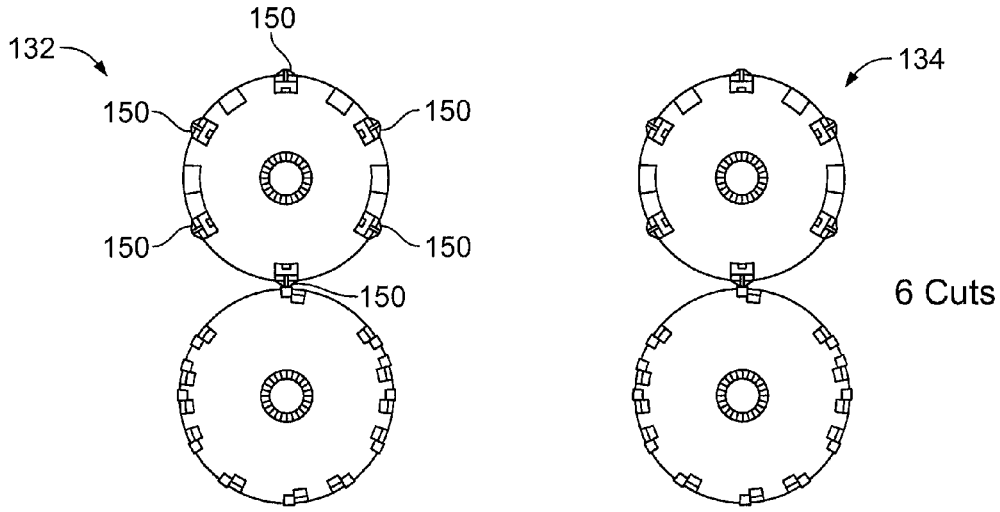
Figure 3:
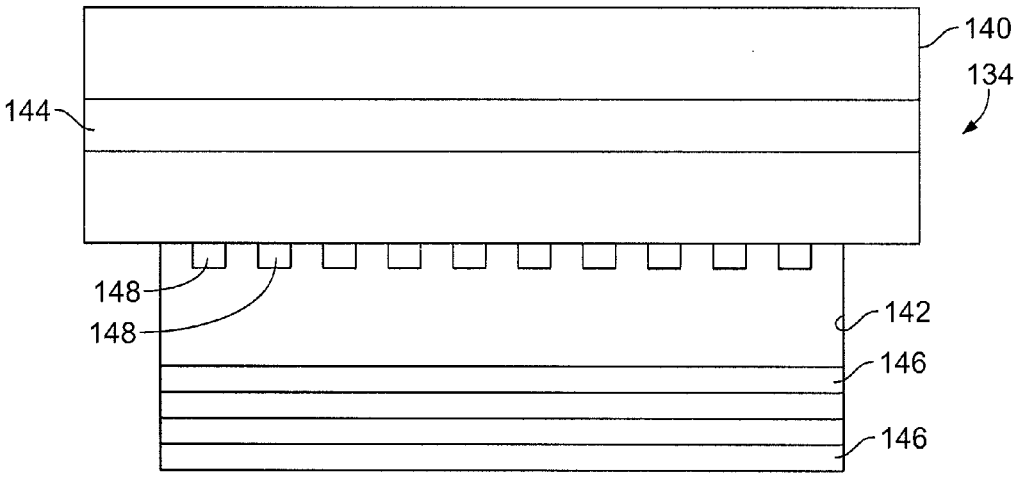
FIG. 3 shows the cutting cylinder pair shown in FIGS. 1 and 2(*a*).

FIG. 1 shows a schematic representation of a printing press including a double cut folder in accordance with the present invention. Printing press 100 may be, for example, a four color web offset printing press. Printing units 112 may each include two print couples, each couple including a plate cylinder 113 and a blanket cylinder 114. Each couple prints on either side of a web 101. Each print unit 112 may print a different a color, for example, magenta, cyan, yellow or black.

Printing press 100 may include a folder 110 for folding, cutting and processing web 101 into signatures 102. Folder 110 may be a pinless former folder, for example. After printing, web 101 may be slit into a plurality of ribbons by a slitter 116, if desired. The ribbons may be combined and transported to a former 120 for longitudinal folding. The former fold 122 is in line with a direction of travel A of web 101.

Folded web 101 may be transported through a plurality of nip rolls 130 to a cutting section 128 of folder 110. Cutting section 128 may include two pairs of cutting cylinders 132, 134. Each cutting cylinder pair 132, 134 includes a respective knife cylinder 140 and a corresponding anvil or cutting rubber cylinder 142 (FIG. 2(*a*)). The web is perforated or cut when the knife of a knife box on knife cylinder 140 meets its associated anvil rubber on anvil cylinder 142 in the nip formed between knife cylinder 140 and anvil cylinder 142.

In the cutting section 128, web 101 is first cut by cutting cylinder pair 132. Cutting cylinder pair 132 may include, for example, four, five or six knife boxes and cut web 101 into signatures 102 having a length of 305 mm, 244 mmm, or 203.33 mm, each, respectively. Cutting cylinder pair 132 may partially cut web 101 and either slit or perforate the web along a width of the web. Second cutting cylinder pair 134 includes the same number of knife boxes as pair 132 and provides the final cut to form signatures 102 from web 101. Fans 152, 154 may receive signatures 102 and deposit signatures 102 on conveyor 156 for further processing.

As shown in FIGS. 2(*b*) and 3, tapes 148 may guide web 101 and signatures 102 during the cutting process. Tapes may be run through the cylinder pair 134. The guidance of tapes 148 reduces the likelihood of product damage during snap-back and eliminates the dynamics of pushing the lead edge of the signature into the entrance of the tapes.

As shown in FIGS. 1 and 2(*a-d*), cutting cylinder pairs 132, 134 are designed to include a plurality of mounting locations 144, 146 for knife boxes or anvil rubber subassemblies. Knife cylinders 140 may be designed to accommodate a plurality of knife boxes 150 by including a plurality of knife box positions 144. For example, knife cylinders 140 may include four knife boxes, six knife boxes, five knife boxes 150 by selecting which of twelve knife box positions 144 (also referred to herein as knife holding locations) hold knife boxes. As shown in FIG. 2(*a*), six knife box positions 144 include knife boxes 150. Thus, knife cylinder 140 is arranged to cut web 101 into six signatures per blanket circumference in accordance with a job C. Knife boxes may be removed and rearranged to accommodate other cutting arrangements, for example a four signature arrangement, job A, and a five signature arrangement, job B. The vacant knife box positions 144 may include spacers or filler pieces. For subsequent cutting jobs, filler pieces may be removed and additional knife boxes 150 may be installed. Thus, knife cylinders 140 may support four, five or six equally spaced knife boxes 150 for example. Knife cylinder 140 may be nominally the same size as blanket cylinder 114, for example, 1220 mm. A shimming mechanism, for example, metal or plastic shims, may also be used to fine tune the relative cut lengths of either the four, five or six signature arrangements by fine tuning the locations of the knife boxes 150 in the locations 144.

The anvil cylinder or cutting rubber cylinder 142 is setup to complement knife cylinder 140. Thus each anvil rubber position 146 (also referred to herein as cutting rubber locations) is located in a position to counteract a knife box 150 of knife cylinder 140. Each anvil rubber position 146 may include an anvil rubber 147. It is not necessary to remove the cutting rubbers. However, fillers may be used to fill positions 146 that are not being used, the unused positions 146 may be left vacant, or they may include anvil rubber 147.

Cutting cylinder pairs 132, 134 may be driven independently to allow variation in the cut off length. One or more drives may be used to rotate the cylinder pairs 132, 134 and the drive(s) may include, for example, a gear train, a belt drive or individual motors. The drive(s) can be supported on a frame holding the cylinder pairs 132, 134 in a conventional manner.

FIGS. 2(*b*) through (*d*) illustrate in further detail how the knife boxes 150 and anvil rubbers 147 can be located on the cylinders 140, 142 to provide four cuts, five cuts, or six cuts during each revolution of a plate cylinder 113 of the printing press 100. Cylinders 134 and 142, respectively, have twelve positions 144 or 146, and are numbered 144-1 through 144-12, and 146-1 through 146-12.

FIG. 2(*b*) illustrates cylinders 140 and 142 in each of cylinder pairs 132 and 134 configured with four knife boxes 150 provide four cuts during each revolution of the plate cylinder 113. If, for example, the cylinders 140 and 142 had a 1220 mm circumference, the arrangement of FIG. 2(*b*) would produce signatures with a length of 305 mm. In FIG. 2(*b*), knife boxes 150 are removably secured in knife box positions 144-1, 144-4, 144-7, and 144-10. The remaining knife box positions have fillers 151 secured therein. For ease of illustration, filler 151 is only labeled in knife box position 144-8. In this regard, the knife boxes 150 or fillers 151 can be secured and removed from the knife box positions 144 via fasteners, such as bolts, for example. Shims can be used in a known manner to more precisely locate the knife boxes 140 in the positions 144. As shown in FIG. 2(*b*), knife box positions 144-1, 144-4, 144-7 and 144-10 are equally spaced apart from each other along the circumference of the cylinder 140. Accordingly, each of the knife boxes 150 are equally spaced apart from each other along the circumference of the cylinder 140, so that they are spaced apart by 90 degrees. Anvil rubbers 147 are included in all twelve anvil rubber positions. However, if desired, anvil rubbers 147 can be provided in positions 146-1, 146-4, 146-7, and 146-10, with the remaining anvil rubber positions left empty or having a filler secured therein. Like the knife boxes, anvil rubbers 147 can be secured and removed via fasteners, and precisely located with shims. Anvil rubber positions 146-1, 146-4, 146-7 and 146-10 are equally spaced apart from each other along the circumference of the cylinder 142. Accordingly, each of the anvil rubbers 147 that interact with knife boxes 146 are equally spaced apart from each other along the circumference of the cylinder 142, so that they are spaced apart by 90 degrees. FIG. 2(*b*) also illustrates the tapes 148 passing between cylinders 140 and 142. Gaps or grooves in the knife boxes 146 and anvil rubbers 147 allow the tapes to pass between the cylinders 140, 142 as is known in the art.

FIG. 2(*c*) illustrates cylinders 140 and 142 in each of cylinder pairs 132 and 134 configured with five knife boxes 150 and five anvil rubbers 147 to provide five cuts during each revolution of the plate cylinder 113. If, for example, the cylinders 140 and 142 had a 1220 mm circumference, the arrangement of FIG. 2(*c*) would produce signatures with a length of 244 mm. In FIG. 2(*c*), knife boxes 150 are removably secured in knife box positions 144-1, 144-3, 144-6, 144-8, and 144-11. As shown in FIG. 2(*c*), knife box positions 144-1, 144-3, 144-6, 144-8 and 144-11 are equally spaced apart from each other along the circumference of the cylinder 140. Accordingly, each of the knife boxes 150 are equally spaced apart from each other along the circumference of the cylinder 140, so that they are spaced apart by 72 degrees. Anvil rubbers 147 are included in all twelve anvil rubber positions. However, if desired, anvil rubbers 147 may be removably secured in anvil rubber positions 146-1, 146-3, 146-6, 146-8, and 146-11, with the remaining anvil rubber positions left empty or having a filler secured therein. Anvil rubber positions 146-1, 146-3, 146-6, 146-8 and 146-11 are equally spaced apart from each other along the circumference of the cylinder 142. Accordingly, each of the anvil rubbers 147 that interact with knife boxes 146 are equally space apart from each other along the circumference of the cylinder 142, so that they are spaced apart by 72 degrees.

FIG. 2(*d*) illustrates cylinders 140 and 142 in each of cylinder pairs 132 and 134 configured with six knife boxes 150 and six anvil rubbers 147 to provide six cuts during each revolution of the plate cylinder 113. If, for example, the cylinders 140 and 142 had a 1220 mm circumference, the arrangement of FIG. 2(*d*) would produce signatures with a length of 203.33 mm. In FIG. 2(*d*), knife boxes 150 are removably secured in knife box positions 144-1, 144-2, 144-5, 144-7, 144-9, and 144-12. As shown in FIG. 2(*d*), knife box positions 144-1, 144-2, 144-5, 144-7, 144-9, and 144-12 are equally spaced apart from each other along the circumference of the cylinder 140. Accordingly, each of the knife boxes 150 are equally spaced apart from each other along the circumference of the cylinder 140, so that they are spaced apart by 60 degrees. Anvil rubbers 147 are included in all twelve anvil rubber positions. However, if desired, anvil rubbers 147 may be removably secured in anvil rubber positions 146-1, 146-2, 146-5, 146-7, 146-9, and 146-12, with the remaining anvil rubber positions left empty or having a filler secured therein. Anvil rubber positions 146-1, 146-2, 146-5, 146-7, 146-9, and 146-12 are equally spaced apart from each other along the circumference of the cylinder 142. Accordingly, each of the anvil rubbers 147 that interact with knife boxes 146 are equally space apart from each other along the circumference of the cylinder 142, so that they are spaced apart by 60 degrees.

A drive for rotating the cylinders 140, 142 could be implemented through a gear set or belt drive or each cylinder could have its own drive motor. Since the rotational speed of the cutting cylinders does not change when producing any one of these discrete cut length products, the drive control is greatly simplified.

The present invention is not limited to a 1220 mm blanket circumference and is applicable to most "double around" long grain or short grain print unit sizes. Further, the present invention is not limited to cylinders having twelve (12) knife box or anvil rubber positions. Rather, greater or fewer positions may be provided on the cylinders, and the cylinders may have a larger or smaller circumference.

The figures show all the knife boxes on one cylinder and the cutting rubbers on the other. However, there alternatively may be a mix of knife and cutting rubbers on each cylinder in order to optimize available geometry.

In the foregoing specification, the invention has been described with reference to specific exemplary embodiments thereof. It will, however, be evident that various modifications and changes may be made without departing from the broader spirit and scope of the invention as set forth in the appended claims. The specification and drawings are accordingly to be regarded in an illustrative rather than a restrictive sense.

What is claimed is:

1. A method of cutting a web into variable length signatures comprising the steps of:

perforating a web with a first cutting cylinder pair and cutting the web into signatures having a first length with a second cutting cylinder pair, wherein each cutting cylinder pair includes a plurality of knife mounting locations and a plurality of cutting rubber locations, each knife mounting location configured to hold a knife box, wherein a first subset of the plurality of knife mounting locations each have a knife box secured therein, and a second subset of the plurality of knife mounting locations does not have a knife box or an anvil secured therein;

on the first cutting cylinder pair and on the second cutting cylinder pair, removing one or more of the knife boxes from the first subset of knife mounting locations and securing one or more knife boxes into respective ones of the second subset of knife mounting locations, and thereafter;

perforating a web with the first cutting cylinder pair and cutting the web into signatures having a second length with the second cutting cylinder pair;

wherein the first cylinder pair includes a first knife cylinder and a first anvil cylinder, and the second cylinder pair includes a second knife cylinder and a second anvil cylinder and the first and second knife cylinders have a same diameter as a blanket cylinder transferring an image to the web.

2. The method of claim 1, wherein the plurality of knife mounting locations include twelve locations, and wherein, during said cutting the web into signatures of the first length, four of the twelve knife mounting locations hold respective knife boxes;

wherein the removing includes removing three of the four knife boxes; and wherein the securing includes securing four or five knife boxes into respective ones of the second subset of knife mounting locations.

3. The method of claim 1, wherein the plurality of knife mounting locations include twelve locations, and wherein, during said cutting the web into signatures of the first length, five of the twelve knife mounting locations hold respective knife boxes;

wherein the removing includes removing four of the five knife boxes; and wherein the securing includes securing three or five knife boxes into respective ones of the second subset of knife mounting locations.

4. The method of claim 1, wherein the plurality of knife mounting locations include twelve locations, and wherein, during said cutting the web into signatures of the first length, six of the twelve knife mounting locations hold respective knife boxes;

wherein the removing includes removing five of the six knife boxes; and wherein the securing includes securing three or four knife boxes into respective ones of the second subset of knife mounting locations.

5. The method of claim 1, further comprising supporting the web and signatures using tapes, the tapes running between the second knife cylinder and the second anvil cylinder.

6. The method of claim 1, wherein all of the knife mounting locations of the first cutting cylinder pair are on the first knife cylinder, and all of the knife mounting locations of the second cutting cylinder pair are on the second knife cylinder.

7. The method of claim 1, wherein some of the knife mounting locations of the first cutting cylinder pair are on the first knife cylinder and some of the knife mounting locations of the first cutting cylinder pair are on the first anvil cylinder; and wherein some of the knife mounting locations of the second cutting cylinder pair are on the second knife cylinder and some of the knife mounting locations of the second cutting cylinder pair are on the second anvil cylinder.

* * * * *